United States Patent [19]

Fowler

[11] Patent Number: 4,984,825

[45] Date of Patent: Jan. 15, 1991

[54] INFORMATION BEARING ASSEMBLY

[75] Inventor: Eugene C. Fowler, Denver, Colo.

[73] Assignee: Tip Computers International, San Diego, Calif.

[21] Appl. No.: 347,245

[22] Filed: May 2, 1989

[51] Int. Cl.[5] ..... B42D 15/00

[52] U.S. Cl. ..... 283/98; 283/99; 283/117; 281/15.1

[58] Field of Search ..... 283/99, 98, 105, 100, 283/112, 114, 81, 117; 101/369; 229/92.8; 281/15.1; 33/458

[56] References Cited

U.S. PATENT DOCUMENTS

| | | | |
|---|---|---|---|
| 1,608,713 | 11/1926 | Anderson | 33/458 |
| 2,681,677 | 6/1954 | Poeltl | 150/39 |
| 2,807,108 | 9/1957 | Fisher | 283/99 |
| 3,230,650 | 1/1966 | Orkin | 283/99 |
| 3,950,871 | 4/1976 | Rege | 40/67 |
| 4,244,603 | 1/1981 | DeMonti | 281/15 |
| 4,318,238 | 3/1982 | Macarle | 40/607 |
| 4,645,701 | 2/1987 | Zarrow | 283/99 |

OTHER PUBLICATIONS

Tip Computers price list, 1988.
Datalizer slide chart.
AT&T information brochure.

*Primary Examiner*—Douglas D. Watts
*Assistant Examiner*—Hwei-Siu Payer
*Attorney, Agent, or Firm*—Brown, Martin, Haller & McClain

[57] ABSTRACT

An information bearing assembly comprises at least two cards each bearing informational indicia on both their front and rear faces. The cards are pivoted together via a pivot connection between the center of the lower edge of the first card and the center of the upper edge of the second card, so that they can be swiveled between a storage position in which they overlap in face to face engagement, and an open position in which the second card is swiveled down relative to the first card until the opposite side edges are aligned and the information carried on the cards forms a continuous vertical column or sequence on both faces of the resultant assembly.

6 Claims, 3 Drawing Sheets

INFORMATION BEARING ASSEMBLY

BACKGROUND OF THE INVENTION

The present invention relates generally to information carrying means or cards of the portable type intended to be carried around for reference when needed.

People tend to carry around a large variety of information in wallets or purses in the form of business cards and the like. Also, since most people carry around various credit cards, credit card size cards bearing information such as calendars have been produced in the past, such cards fitting conveniently into credit-card size pockets in wallets or purses. One inconvenience is that due to the relatively small size of the standard credit card, not much information can be carried on a single card of this size.

SUMMARY OF THE INVENTION

It is an object of this invention to provide an improved portable information carrying assembly.

According to the present invention, an information carrying assembly is provided which comprises at least two cards each carrying informational indicia on both their front and rear faces, the information on the cards forming a sequence starting on the front face of the first card, continuing to the front face of the second card, then to the rear face of the first card and finally to the rear face of the second card. The cards are pivotally secured together via a pivot connection between the center of the lower edge of the first card and the center of the upper edge of the second card, allowing the cards to be swiveled relative to one another between a collapsed, storage position in which they are located one on top of the other in face to face engagement, and an extended, open position in which the second card is swiveled down relative to the first card until the opposite side edges of the two cards are aligned and the information on the resultant arrangement forms a continuous vertical sequence on both the front and the rear face.

Additional cards carrying information in the same manner may be pivotally connected to the first two in a similar fashion if the required information cannot be provided in the space available on the front and rear faces of the first two cards. In this case, each additional card is pivoted at the center of its upper edge to the lower edge of the next preceding card in the sequence, and the information on the cards is arranged so that it forms a continuous sequence extending from the top of the front face of the first card in the assembly to the bottom of the front face of the final card, and then from the top of the rear face of the first card in the assembly down to the bottom of the rear face of the final card. Alternatively, the information on the rear face of the assembly may be inverted relative to the front and extend from the bottom edge of the final card to the top of the first card.

The cards may be of cardboard or plastics material, and are preferably of credit-card size so that they can be easily carried around for ready reference in wallets, purses, pockets or the like. Any type of useful information may be provided on the cards, and the information may be arranged in any logical sequence, for example in alphabetical order. In one specific example, tipping information is provided on the cards to indicate the customer tipping practices for various services. Such information may be particularly useful for travelers, for example, since sets of cards bearing information regarding tipping practices in various countries may be provided. Other useful information may comprise tables of figures for adding fixed percentages to a billed amount, for example, making it easier for the user to determine the appropriate tip.

The cards when folded into the collapsed storage position are no bigger than a credit card, so that they take up little space yet can carry a large amount of information in a convenient, easy access form.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
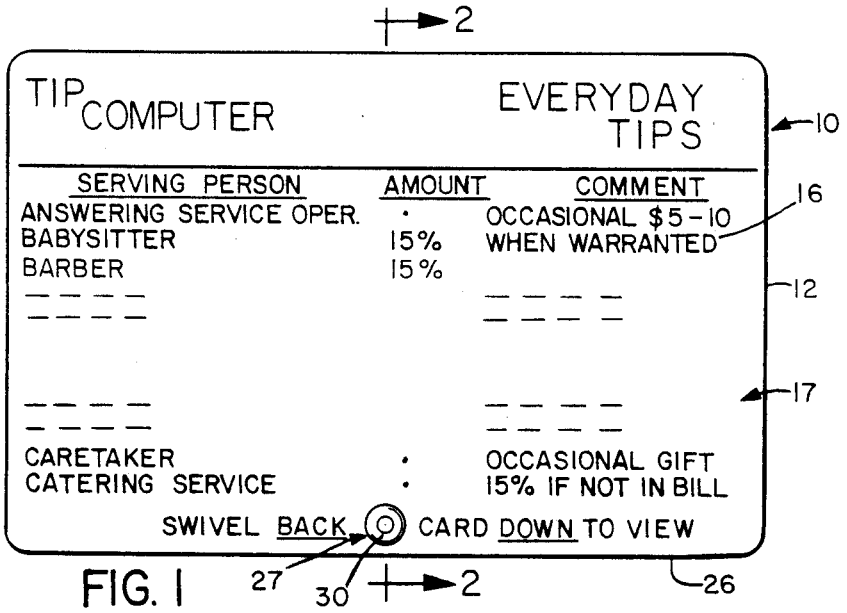
FIG. 1 is a top plan view of an information bearing assembly according to a preferred embodiment of the present invention with the cards in the collapsed, storage position.

FIGS. 1 to 5 of the drawings illustrate a preferred embodiment of the portable, information bearing assembly 10 of this invention. In the illustrated embodiment, the information carried by the assembly concerns standard tipping practices. However, it will be understood that the assembly may be arranged to carry any type of information which would provide a useful reference source, for example for shopping, travel, business or other applications.

The assembly basically comprises two cards 12,14 each bearing informational indicia 16 on both their front faces 17,18 and their rear faces 20,22. The cards are preferably of credit card dimensions, for example of the order of 3⅜ inches by 2⅛ inch, and may be of any suitable relatively rigid material, such as cardboard or plastics material. In the preferred embodiment of the invention, the cards are of heavyweight plastic material of the type used in manufacturing credit cards.

A pivotal connection 24 is provided between the center of the lower edge 26 of the first card 12 and the center of the upper edge 28 of the second card 14. The connection 24 preferably comprises a center eyelet or rivet 30 as best illustrated in FIGS. 1 and 2.

Figure 2:
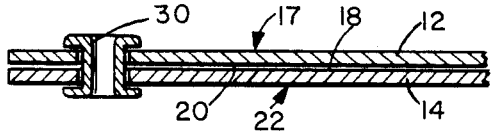
FIG. 2 is a cross-section on the lines 2—2 of FIG. 1.
Figure 4:
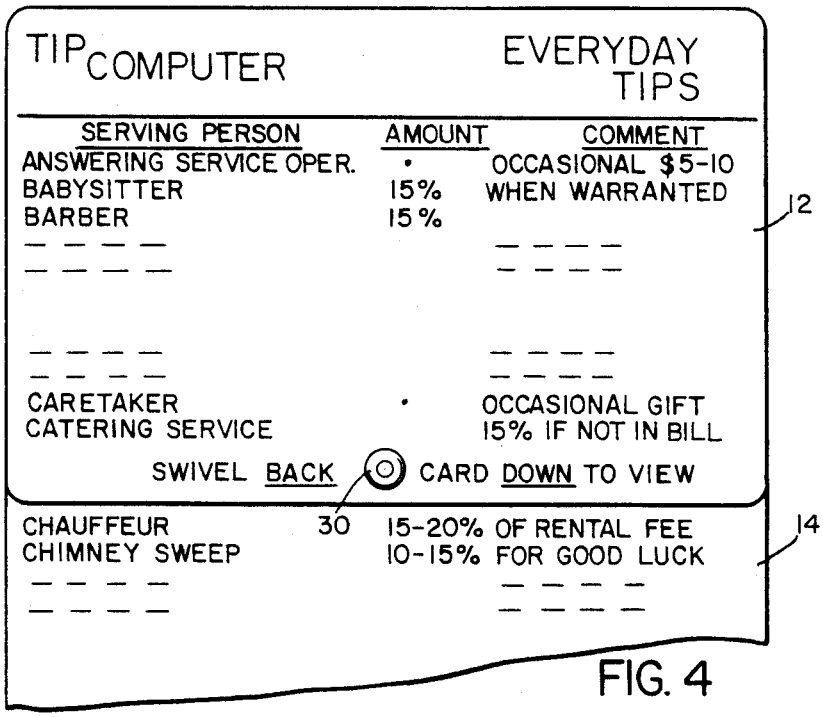
FIG. 4 is a top plan view of the assembly showing the lower card swiveled into the extended viewing position for allowing viewing of all the information on both cards.
Figure 3:
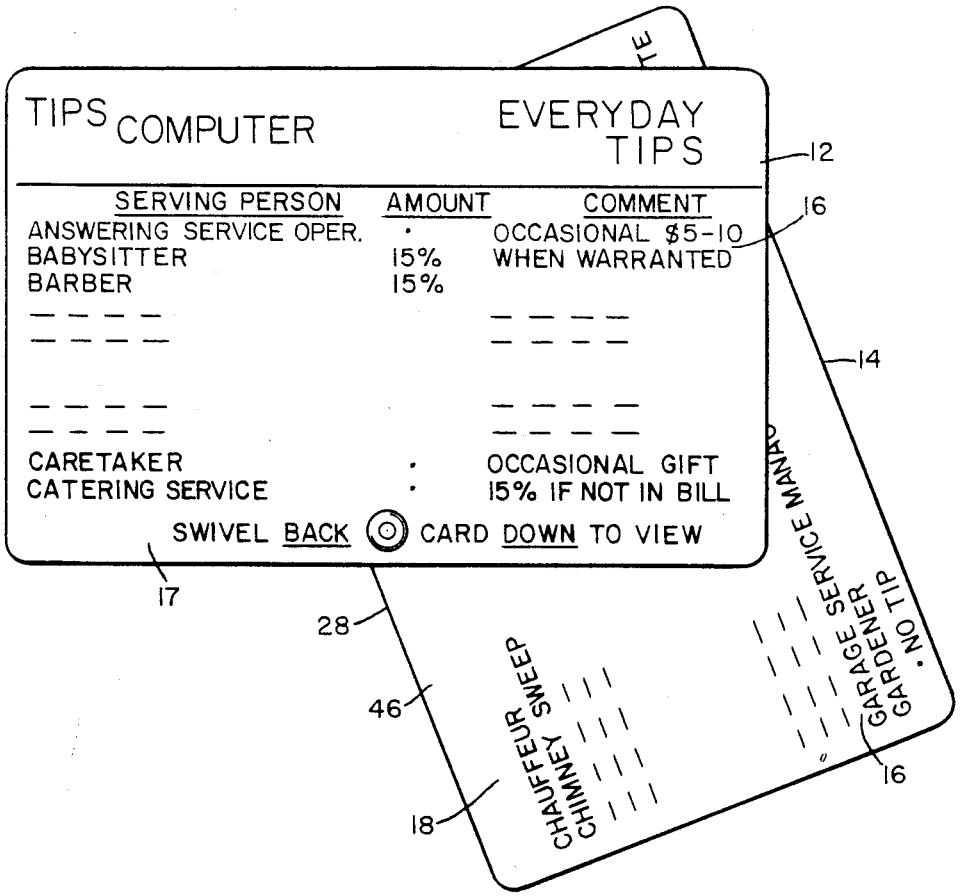
FIG. 3 is a top plan view of the assembly showing the lower card swiveled into an intermediate position between the storage position and an extended, viewing position.

The pivotal connection 24 allows the cards to be swiveled relative to one another between the collapsed, storage position of FIG. 1 in which they are stacked one on top of the other in face to face engagement, and the extended position of FIG. 4 in which the lower card 14 is swiveled downwardly in a clockwise direction relative to the upper card 12 (see FIG. 3) until the opposite side edges of the two cards are aligned as in FIG. 4 with the information on both the cards completely visible.

The information 16 provided on the cards may be printed, embossed or applied in any suitable manner and is arranged such that, when the cards are extended as illustrated in FIG. 4, it forms a continuous sequence starting at the top of the front face 17 of the first card, and extending to the bottom of the front face 18 of the second card, and from there continuing from the top of the rear face 20 of the first card (see FIG. 5) to the bottom of the rear face 22 of the second card. The information may be provided in any logical sequence, for example in alphabetical order as indicated in the particular example illustrated in the drawings.

Figure 6:
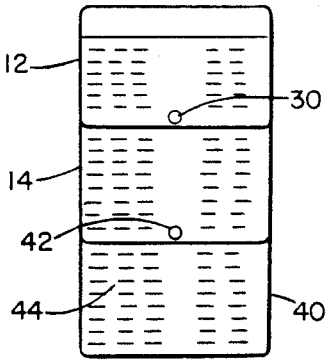
FIG. 6 is a top plan view of a modified assembly.

If two credit-card sized cards provide insufficient space for conveying all the desired information, additional cards may be pivoted to the first pair in a similar fashion, as indicated in FIG. 6. As illustrated in FIG. 6, an additional card 40 is connected to the first two via a center eyelet connection 42 between the lower edge of the second card 14 and the upper edge of the additional card 40. Informational indicia 44 carried on the additional card will form a continuous sequence with that on the first and second cards when all three cards are opened out as illustrated in FIG. 6. More than one additional card may be connected to the first two in a sequential manner, if additional information bearing space is needed, with each additional card being pivotally connected at the center of its upper edge with the center of the lower edge of the next preceding card in the sequence.

Figure 5:
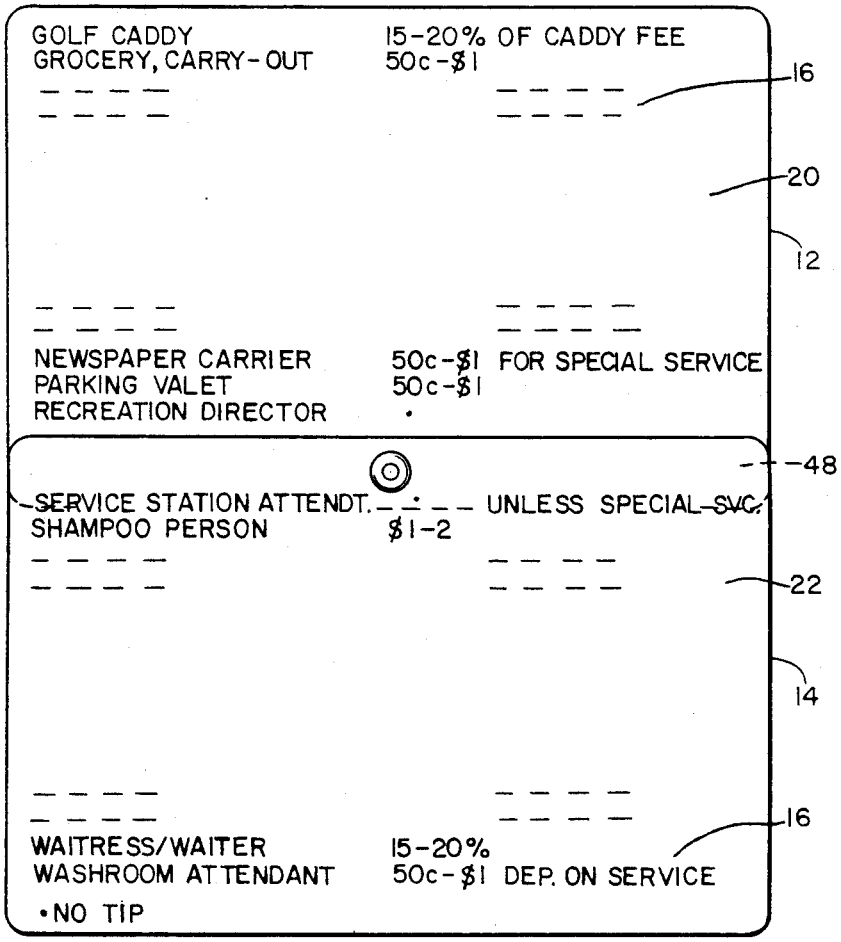
FIG. 5 is a plan view of the rear of the assembly in the position of 4.

As can be seen from the drawings, the information carried on the opposite faces of the cards is positioned such that none of the information on the front or rear face is covered up or obscured by the overlapping edge of the uppermost card in the extended position. Thus, a space 46 is provided at the top of the front face of the second card 14 where the first card will overlap it in the extended position of FIG. 4. Similarly, a blank space 48 is provided at the bottom of the rear face of the first card 12 where the second card will overlap it, as illustrated in FIG. 5.

This assembly provides a compact, easy to carry, quick reference source for a wide variety of needed or useful consumer information. A large amount of information can be carried using this assembly and is immediately available when needed. The card assembly may be carried directly in a wallet, purse or pocket, or may be carried in a special carrying case provided for that purpose.

Although a preferred embodiment of the invention has been described above by way of example only, it will be understood by those skilled in the field that modifications may be made to the disclosed embodiment without departing from the scope of the invention, which is defined by the appended claims.

I claim:

1. An information bearing assembly, comprising:

first and second flat information bearing cards of substantially identical shape and dimensions, each having parallel upper and lower edges and opposite side edges and informational indicia arranged in an alphabetical sequence on both front and rear faces arranged in successive, spaced rows extending parallel to said upper and lower edges;

pivot means for pivotally connecting said cards together at a central position on the lower edge of the first card and a central position on the upper edge of the second card;

said pivot means comprising means for allowing aid cards to swivel relative to one another between a storage position in which they are positioned one on top of the other in face to face engagement and an open position in which the second card is swiveled downwardly relative to the first card until the opposite side edges of the card are aligned and the informational indicia on the cards forms a continuous vertical sequence on both faces of the cards of spaced successive rows of information reading parallel to the upper and lower edges of the cards, the information sequence continuing successively from the front face of the open cards to the rear face of the open cards.

2. The assembly as claimed in claim 1, wherein said pivot means comprises a central eyelet connection between the center of the lower edge of the first card and the center of the upper edge of the second card.

3. The assembly as claimed in claim 1, including at least one additional information bearing card having parallel upper and lower edges and carrying information on both its faces for forming a continuous sequence with information carried on the first and second cards, and pivot means pivotally connecting a central position on the lower edge of the second card with a central position on the upper edge of the additional card for allowing the additional card to be swiveled downwardly relative to the first two cards into an open position in which all three cards are visible with their side edges aligned and the information on the opposite side faces of the cards forms a continuous sequence from the top of the front face of the first card to the bottom of the front face of the additional card, and continues from the top of the rear face of the first card to the bottom of the rear face of the additional card.

4. The assembly as claimed in claim 3, including a plurality of additional cards each carrying informational indicia forming a sequence with the remaining cards, each additional card being pivotally secured at the center of its upper edge to the center of the lower edge of the next preceding card in the sequence.

5. An information bearing assembly, comprising:

first and second flat information bearing cards of substantially identical shape and dimensions, each having parallel upper and lower edges and opposite side edges and a sequence of informational indicia on both front and rear faces;

pivot means for pivotally connecting said cards together at a central position on the lower edge of the first card and a central position on the upper edge of the second card;

said pivot means comprising means for allowing said cards to swivel relative to one another between a storage position in which they are positioned one on top of the other in face to face engagement and an open position in which the second card is swiveled downwardly relative to the first card until the opposite side edges of the cards are aligned and the informational indicia on the card forms a continuous vertical sequence on both faces of the cards; and the cards being of plastic material and of credit card size of around $3\frac{3}{8}$ inches by $2\frac{1}{8}$ inches.

6. The assembly as claimed in claim 5, wherein the upper and lower edges are the longest edges of each card.

* * * * *